US006260600B1

(12) United States Patent
Miller

(10) Patent No.: US 6,260,600 B1
(45) Date of Patent: Jul. 17, 2001

(54) CURTAIN ROD ASSEMBLY FOR WINDOW TREATMENTS

(75) Inventor: Fran Miller, Milford, IN (US)

(73) Assignee: Fabric Expressions, Milford, IN (US)

( * ) Notice: Subject to any disclaimer, the term of this patent is extended or adjusted under 35 U.S.C. 154(b) by 0 days.

(21) Appl. No.: 09/277,834

(22) Filed: Mar. 26, 1999

(51) Int. Cl.[7] ..... E04F 10/00

(52) U.S. Cl. ..... 160/38; 160/19; 160/39; 160/330

(58) Field of Search ..... 160/30, 38, 39, 160/19, 63, 237, 330; 211/105.1, 105.2

(56) References Cited

U.S. PATENT DOCUMENTS 4,865,105 * 9/1989 Peters ..... 160/38
4,921,031 * 5/1990 Wagner et al. ..... 160/38
5,042,549 * 8/1991 Roberts ..... 160/39
5,230,375 * 7/1993 Linder ..... 160/39
5,361,821 * 11/1994 Barone ..... 160/39
5,505,245 * 4/1996 Badalamenti ..... 160/38
5,785,104 * 7/1998 Riley et al. ..... 160/38
5,803,144 * 9/1998 Ives ..... 160/38
5,848,628 * 12/1998 Badalamenti ..... 160/38
5,881,471 * 3/1999 Kaluza ..... 33/563
5,927,362 * 7/1999 Smiley et al. ..... 160/38
5,950,255 * 9/1999 Thompson ..... 4/557

* cited by examiner

*Primary Examiner*—Bruce A. Lev
(74) *Attorney, Agent, or Firm*—Baker & Daniels

(57) ABSTRACT

A window treatment assembly comprising a conventional curtain rod which is formed to be longitudinally telescopic to the accommodate various widths of windows. The curtain rod is attachable to a wall by way of brackets having hooks which cooperate with apertures in the curtain rod members. Shaping members, preferably formed from Styrofoam having a circular cross section a receivable over the curtain rods to provide shaping formation to draperies, valances, and various other window treatments which are slidably receivable over the assembly.

10 Claims, 5 Drawing Sheets

CURTAIN ROD ASSEMBLY FOR WINDOW TREATMENTS

BACKGROUND OF THE INVENTION

1. Field of Invention

This invention relates to assemblies for hanging window treatments at or adjacent to windows for decorative and privacy purposes.

2. Prior Art

It is certainly well known in the industry and the market place to provide hanging assemblies for mounting window treatments and draperies adjacent to windows for decorative and privacy purposes. One such method is to have various brackets which are attached by fastening members to a wall adjacent to the windows, where a telescopic rod is adjustable in length to adapt to the brackets on the wall. Such rods are typically stamped and formed from metal to include L-shaped legs at each end thereof, where the rod assembly includes two rods, with one of the rod halves being slightly larger in cross section than the other, to provide overlapping telescopic longitudinal movement between the two. This allows such curtain rods to be easily adaptable to a variety of widths of windows, by simply attaching the brackets to the wall and adjusting the rod according to the bracket dimension.

In the recreational vehicle (RV industry) it is common to provide a means of hanging curtains by an assembly similar to that depicted in FIG. 1, whereby an assembly according to reference numeral 2 is used. This assembly is generally comprised of a length of PVC pipe and having two PVC elbows 6 attached at opposite ends thereof in a known fashion, whereby the ends of the PVC pipe 4 are friction fitted into openings 8 in the elbows 6. Openings 10 of the elbows 6 are meanwhile friction fitted over cupped portions 14 of flanges 12 which can be attached to the wall, adjacent to windows. Prior to the installation of the assembly to the flanges 12, it should be appreciated that curtains or valances can be slidably received over the PVC pipe 4 for attachment adjacent to the windows.

While this assembly accomplishes the task at hand, this assembly proves to be quite expensive, given the plastic fittings and flanges, and at the same time proves to be inflexible and requires special tools to vary the length of the PVC members, particularly the PVC pipe 4.

It is therefore desirable to provide in the market place, an assembly which is more flexible in use, is more easily adaptable to various situations, and provides a more cost efficient method of accomplishing the window treatment attachment.

SUMMARY OF THE INVENTION

The above object has been accomplished by providing an apparatus for hanging a form a draperies, comprising a longitudinal shaping member which is receivable over a curtain rod, where the longitudinal shaping member is profiled with a desired configuration. In this manner, when the draperies are slidably received over the longitudinal shaping member, the draperies conform to the desired profile.

DETAILED DESCRIPTION OF THE PREFERRED EMBODIMENT

Figure 1:
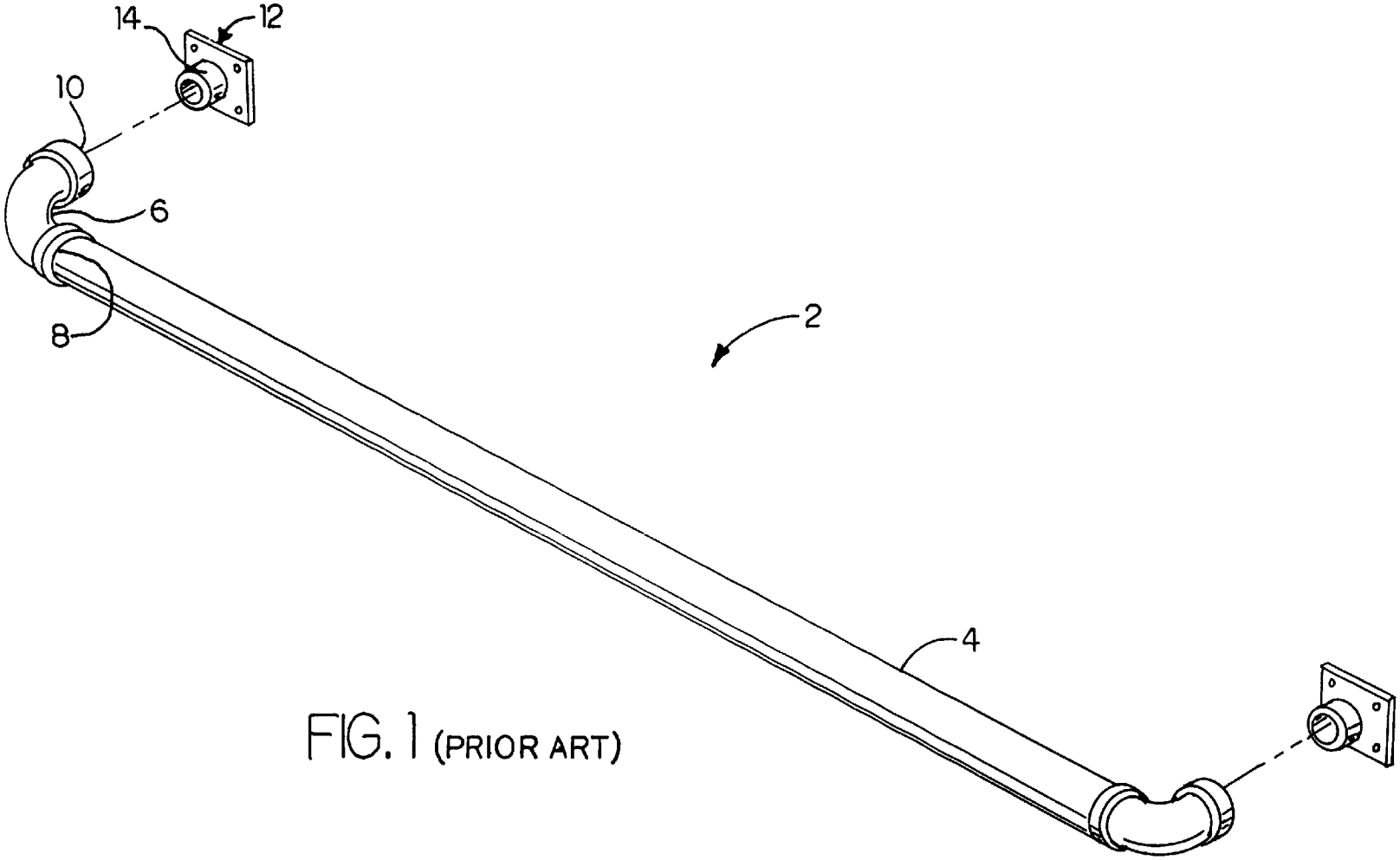
FIG. 1 (PRIOR ART)
FIG. 1 is a perspective view of the prior art assembly.
Figures 2, 3:
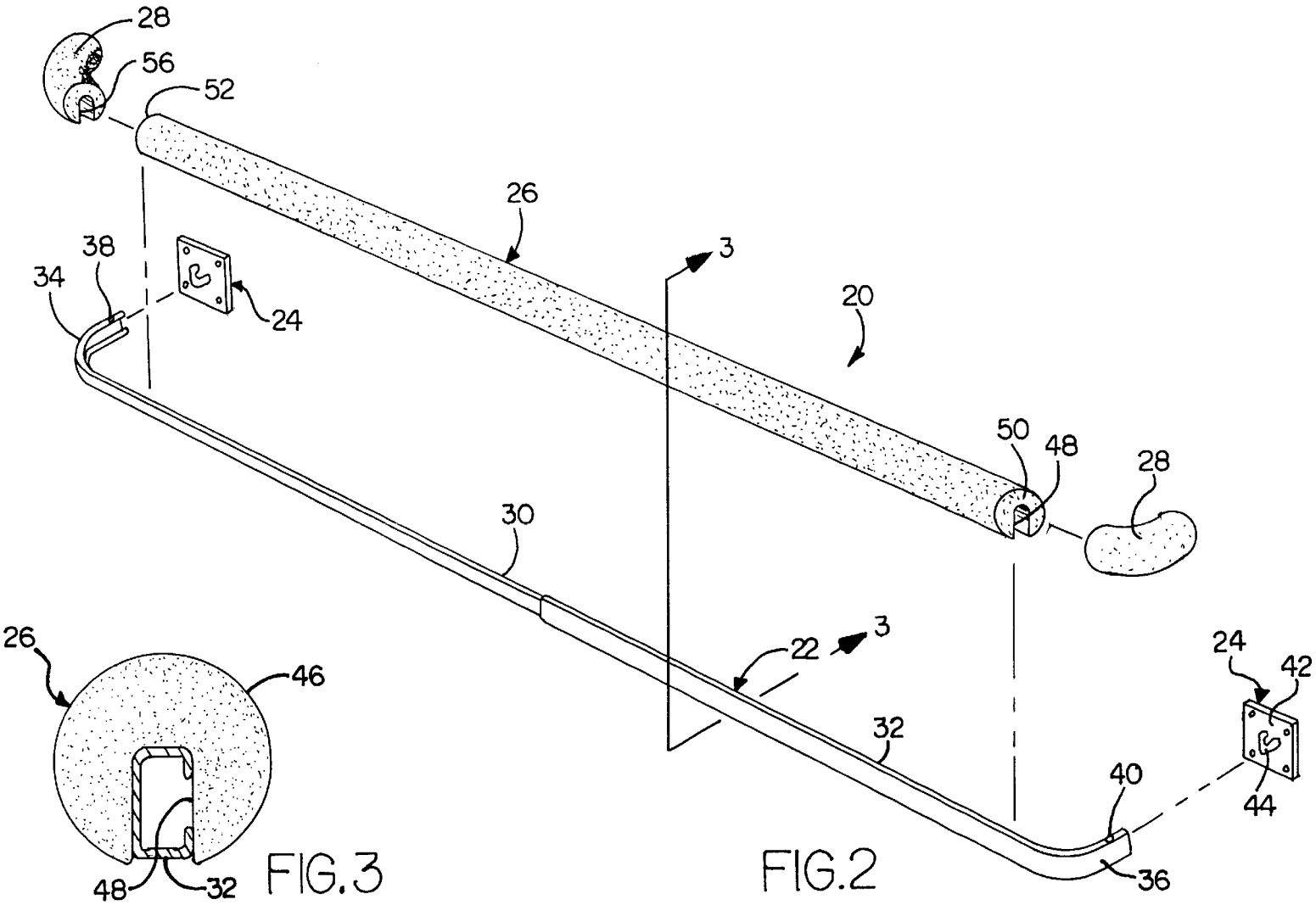
FIG. 2 is a perspective view of the curtain rod assembly of the subject invention.
FIG. 3 is a cross sectional view through lines 3—3 of FIG. 2 when the apparatus is fully assembled.

With reference now to FIG. 2, the preferred embodiment of the invention will now be described. The apparatus is shown generally at 20, comprising a conventional curtain rod 22, bracket members 24 at opposite ends, a molded shaping member 26, and formed shaping elbows 28.

With reference still to FIG. 2, the curtain rod 22 includes cooperating members 30 and 32 of substantial C-shaped cross section, where member 32 would include a larger cross sectional configuration than that of member 30, so as to be slidably receivable over member 30 such that the two member can be longitudinally telescopic relative to each other. At opposite ends of the two members 30 and 32, L-shaped leg members 34 and 36 are integrally attached, each of which include an aperture 38 and 40 respectively for the purpose of hanging the curtain rods as will be described herein.

With reference still to FIG. 2, bracket members 24 include a flange section 42 having a plurality of apertures extending there through for the purpose of hanging a bracket, and a hook shaped member 44 extending outwardly therefrom. It should be appreciated that the profile of the hook member 44, and the dimension of the aperture 38 and 40 is such that each open end of the L-shaped legs 34 and 36 can be slidably received over the hook and be captured within the apertures 38 and 40 to be held in conventional manner.

With respect now to both FIGS. 2 and 3, the shaping member 26 will be described in greater detail. Shaping member 26 is preferably molded from a light inexpensive material such as STYROFOAM, to have a substantial circular cross section having an outer surface 46 as shown in FIG. 3, and to include an elongate slot 48, and including end surfaces 50 and 52. As should be understood more clearly from FIG. 3, the slot 48 should be profiled to be receivable over the largest of the C-shaped members 32. Due to the elongate nature of the slot 48, it should be appreciated that the shaping member 26 will reside on the rod assembly 30, 32 due to it's own weight, while at the same time will not rotate about the rod. As shown in FIG. 2, the shaping elbows 28 each include a curved slot 56, profiled to be receivable over a corner formed between the members 30, 32 and their respective L-shaped leg portions 34, 36.

With the above mentioned apparatus, a window treatment would be assembled as follows. It should be appreciated that bracket members 24 would be first positioned adjacent to a window to be treated, and attached to a wall by way of fasteners through the apertures in the flange member 42. The elongate shaping member 26, and the shaping elbows 28 would be received over the rod assembly 30, 32 and a window treatment to be installed would be slidably received over the combination of the shaping members 26 and 28, and over the rod assembly 30, 32. The window treatment would be inserted over the assembly so that the L-shaped members 34 and 36 slightly protrude through the window treatment to provide access to the apertures 38 and 40 for assembly of the window treatment to the bracket members 24.

It should be appreciated that any size of window treatment, and number of curtain rod and shaping member assemblies could be provided, and a variety of possibilities are shown in FIGS. 4*a*–4*j*.

Figure 4B:
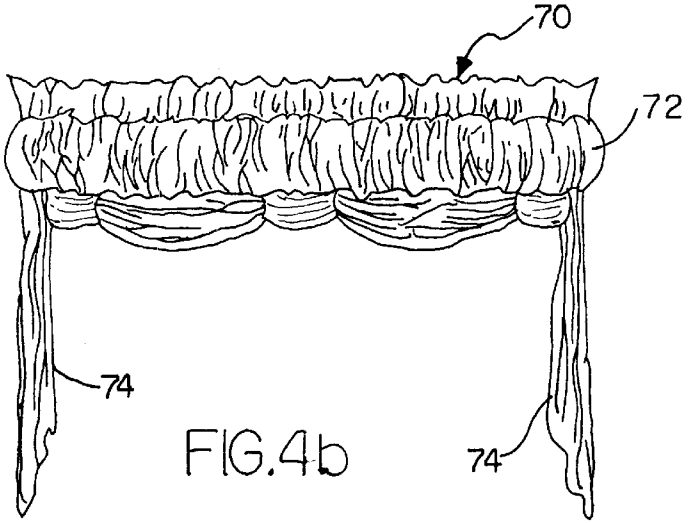
FIGS. 4*a*–4*j* show various embodiments of window treatments which can be installed using the assembly of the subject invention.
Figure 4D:
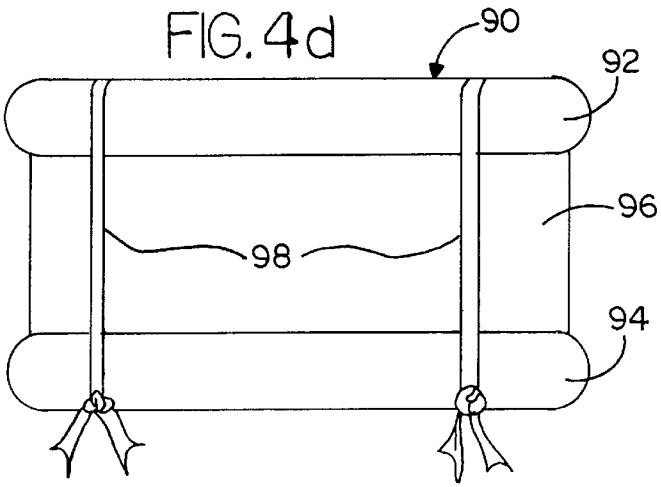
Figure 4A:
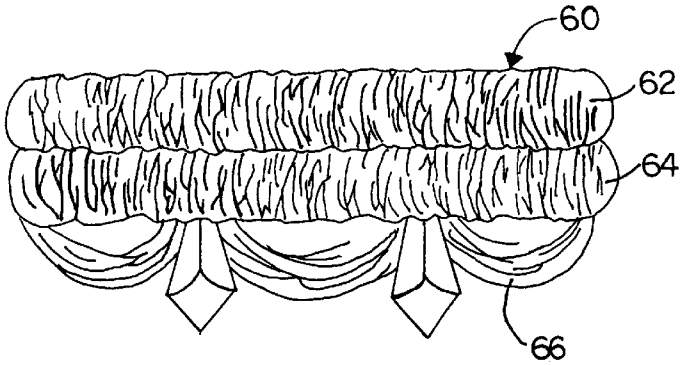

With respect first to FIG. 4*a*, an assembly is shown at 60 including two sections of fabric openings at 62 and 64, both of which would be slidably receivable over a discrete combination 20, to include a gathered section of fabric 66 extending from a lower section thereof.

FIG. 4*b* shows a window treatment assembly 70 comprising a single fabric opening at 72 which would be profiled for slidable receipt over a single assembly 20, where side portions 74 extend in a flanking relation to the window for decorative purposes.

Figure 4C:
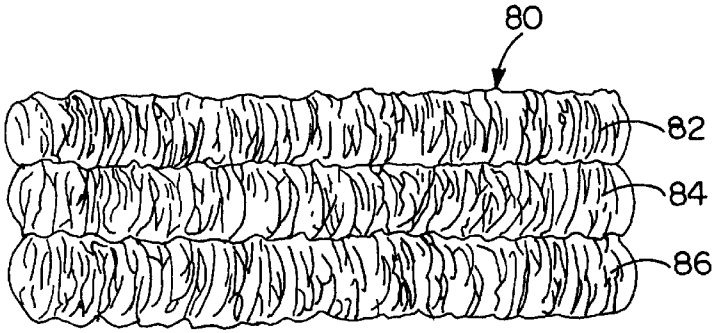

As shown in FIG. 4*c*, an assembly is shown at 80 comprising a simple valance section including three sections of gathered fabric forming openings at 82, 84, and 86 for slidable receipt over an assembly 20.

FIG. 4*d* shows an assembly 90 having two fabric sections 92 and 94 which are slidable received over the assembly 20 and include an intermediate section 96 extending from sections 92 and 94. Decorative members 98 such as ribbons could be included to dress up the valance.

Figure 4F:
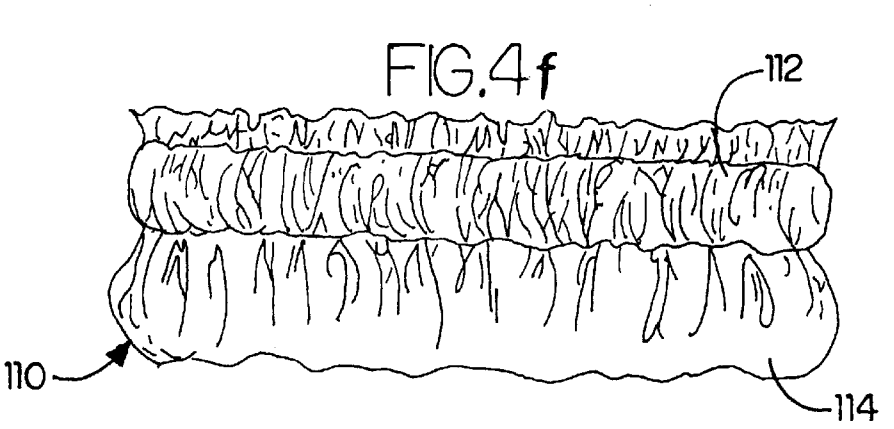
Figure 4H:
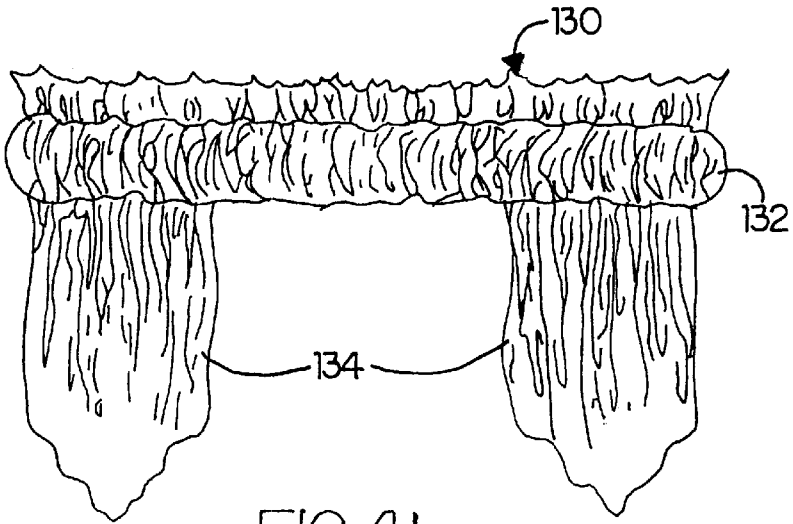
Figure 4E:
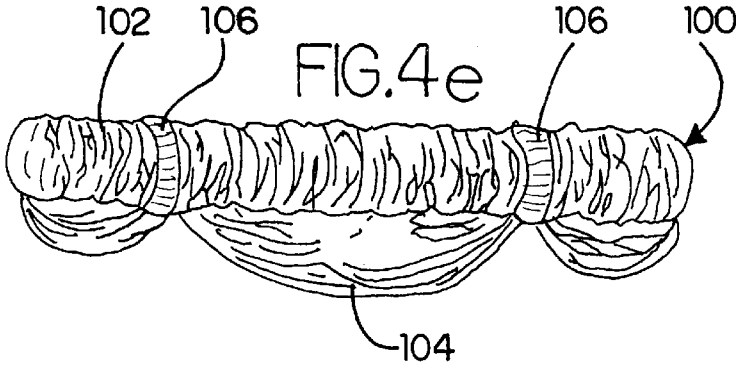

FIG. 4*e* shows a treatment 100 including a single section of gathered fabric forming an opening at 102 for slidable receipt over the assembly 20 including a valances section 104 extending downwardly therefrom, and tied portions 106 for gathering the fabric as shown.

FIG. 4*f* shows a valance assembly 110 having a single section of gathered fabric at 112 for slidable receipt over the assembly 20 with a valance fabric section 114 extending downwardly therefrom.

Figure 4G:
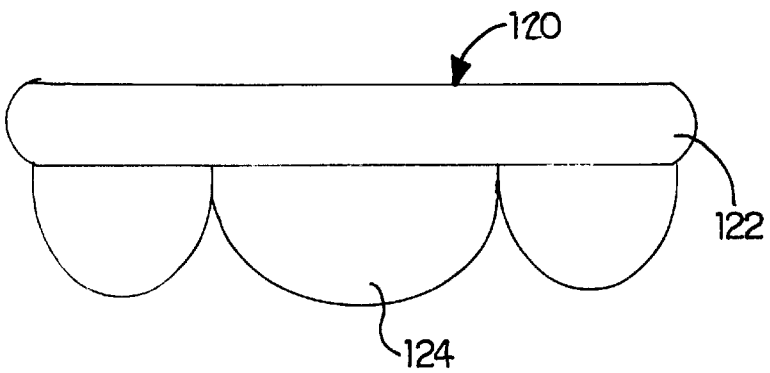

FIG. 4*g* shows an assembly 120 having a single fabric section forming an opening 122 for slidable receipt over the assembly 20 having valanced sections 124 extending downwardly therefrom.

FIG. 4*h* shows an assembly 130 having a single section of gathered fabric at 132 for slidable receipt over the assembly 20 with drapery sections 134 flanking a window to be covered.

Figure 4J:
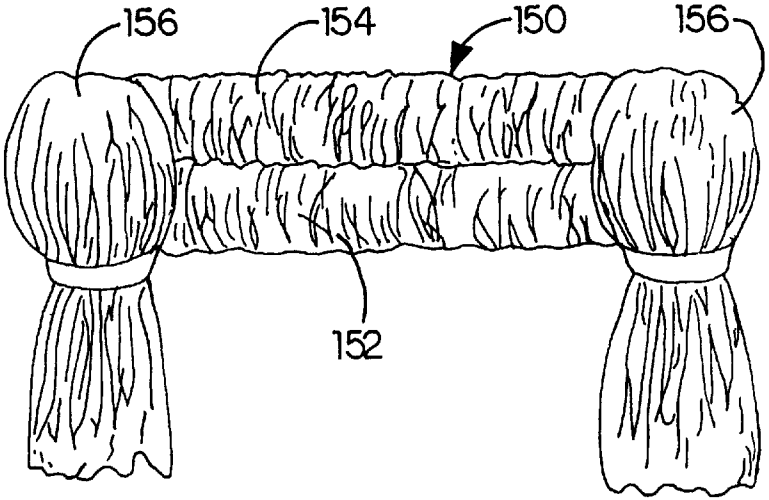
Figure 4I:
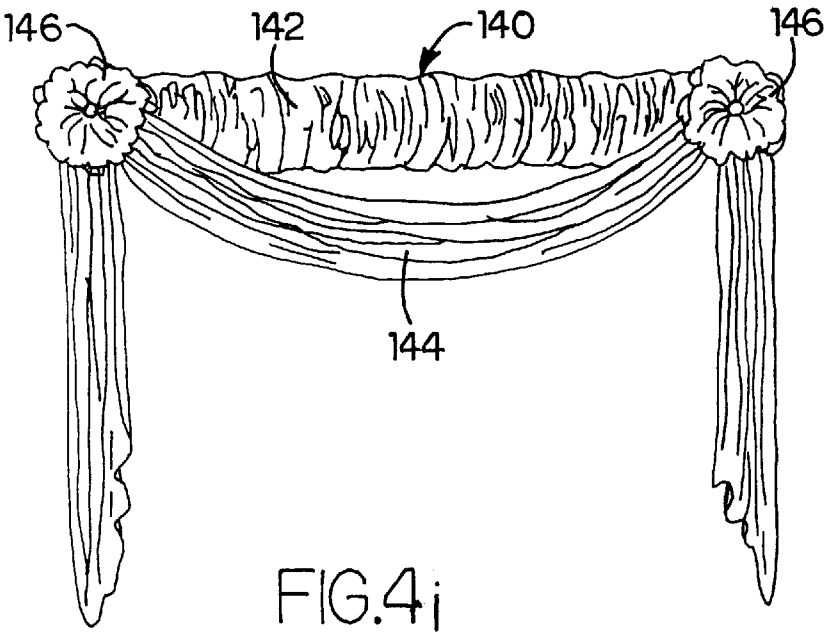

FIG. 4*i* shows an assembly 140 having a single section of gathered fabric at 142 which is slidably receivable over the assembly 20 with a fabric member 144 attached at opposite ends of the member 140 for decorative purposes, being attached at opposite ends by fabric buttons 146.

FIG. 4*j* shows an assembly 150 having two gathered sections 152, 154 profiled for slidable receipt over the member 20 and including draped sections 156 at opposite ends thereof for decorative purposes.

The preferred embodiment of the invention has been described by way of the attached drawing Figures, but it should be appreciated that the true breath of the invention is limited only the claims. It should also be understood that modifications can be made to the application without departing from the true spirit of the invention. More particularly it would be obvious to one of skill in the art to provide a shaping member comprised of a material other than STYROFOAM to include any material such as a paper derivative, plastic and the like. It should also be appreciated that other forms of existing standard curtain rods could be utilized, such as those which are circular in cross section and coaxially extending telescopically in the longitudinal direction.

What is claimed is:

1. An apparatus for hanging a form of draperies, comprising a longitudinal shaping member having a fixed shape and complementary curved corner shaping members, said corner shaping member bent about a longitudinal axis of said members for conforming to the shape of a conventional drapery rod both the longitudinal shaping member and corner shaping members being receivable over a curtain rod and being profiled with a desired configuration, whereby, said longitudinal shaping member and corner shaping members can slidably receive draperies to create a conforming profile.

2. An apparatus for hanging a form of draperies adjacent a window, comprising, wall mountable curtain rod brackets; a conventional curtain rod profiled for mountable receipt upon said brackets, for positioning said rod adjacent the window; and a shaping member attachable to said rod, said shaping member being profiled with a desired configuration and having a slot profiled to receive said curtain rod, said slot being located at a bottom portion of said shaping member, said shaping member being slidably receivable over the top of said curtain rod whereby said shaping member is positioned about the top and sides of said rod with said rod located in said slot, said shaping member substantially surrounding said curtain rod.

3. The apparatus of claim 2, further comprising complimentary corner shaping members receivable over corner sections of the curtain rod.

4. The apparatus of claim 2, wherein the shaping member has a substantially cylindrical configuration.

5. A window valence assembly for use about a window, comprising: wall mounted curtain rod brackets; a conventional curtain rod mountably received by said brackets for positioning said rod adjacent the window; a foam shaping member attachable to said curtain rod, said shaping member being profiled with a desired configuration; and a fabric assembly, profiled substantially in the shape of a tube having an opening therethrough, said shaping member and said curtain rod received in said opening and circumferentially surrounded by said tube said assembly having only a single curtain rod received in any said tube.

6. The apparatus of claim 5, further comprising complimentary corner shaping members receivable over corner sections of the curtain rod.

7. The apparatus of claim 5, further comprising a second set of curtain rod brackets, a second curtain rod, a second shaping member, and a second fabric assembly mounted parallel to the first curtain rod.

8. The window valance assembly of claim 7, wherein the first and second curtain rods are mounted such that the first and second shaping members are in substantial abutting relation, with the associated fabric trapped therebetween.

9. The window valance assembly of claim 7, wherein the first and second curtain rods are mounted in a spaced apart relation with intermediate fabric material integrally joining the first and second fabric assemblies.

10. The window valance assembly of claim 5, wherein the fabric assembly includes a valance section extending downwardly therefrom.

* * * * *

UNITED STATES PATENT AND TRADEMARK OFFICE

CERTIFICATE OF CORRECTION

PATENT NO. : 6,260,600 B1
DATED : July 17, 2001
INVENTOR(S) : Fran Miller

It is certified that error appears in the above-identified patent and that said Letters Patent is hereby corrected as shown below:

Claim 5,
Lines 36-37, delete semicolon after "configuration" and add -- and slidably received over said curtain rod; --
Line 40, add comma after "tube"

Signed and Sealed this

Nineteenth Day of February, 2002

*Attest:*

*Attesting Officer*

JAMES E. ROGAN
*Director of the United States Patent and Trademark Office*